US007663318B2

(12) United States Patent
Koenigsberg et al.

(10) Patent No.: US 7,663,318 B2
(45) Date of Patent: Feb. 16, 2010

(54) HID LAMP WITH RAPID RELIGHT AID

(75) Inventors: William D Koenigsberg, Concord, MA (US); Adam Scotch, Amesbury, MA (US); Walter P Lapatovich, Boxford, MA (US); Victor Perez, Manchester, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 365 days.

(21) Appl. No.: 11/901,532

(22) Filed: Sep. 18, 2007

(65) Prior Publication Data

US 2009/0072740 A1 Mar. 19, 2009

(51) Int. Cl.
*H01J 61/54* (2006.01)
*H01J 17/30* (2006.01)

(52) U.S. Cl. ..... 313/595; 313/600

(58) Field of Classification Search ..... 313/594, 313/595, 600, 601, 596, 597, 598, 599, 491, 313/574, 575, 631, 633

See application file for complete search history.

(56) References Cited

U.S. PATENT DOCUMENTS 6,445,129 B1 9/2002 Seiler

FOREIGN PATENT DOCUMENTS

SU 1166348 A * 7/1985

* cited by examiner

*Primary Examiner*—Peter J Macchiarolo
*Assistant Examiner*—Glenn Zimmerman
(74) *Attorney, Agent, or Firm*—Edward S. Podszus

(57) ABSTRACT

The restrike time for re-light up of an arc discharge lamp may be decreased by including at least one refractory bimetallic start up electrode that provides a shorter arc path intermediate the main arc path in a cool state, but when heated withdraws to have a relatively longer arc path. The longer arc path in the hot state results in a relatively higher path impedance that can be used by itself or in combination with a supplemental impedance device to extinguish the starting arc in favor of the main arc. The withdrawn bimetallic starting electrode then does not interfere with the main arc function.

22 Claims, 8 Drawing Sheets

HID LAMP WITH RAPID RELIGHT AID

TECHNICAL FIELD

The invention relates to electric lamps and particularly to electric discharge lamps. More particularly the invention is concerned with electric discharge lamps with restrike capability.

BACKGROUND ART

When the arc in an operating high intensity discharge (HID) lamp is momentarily interrupted so as to be extinguished, the high electrical resistance of the hot lamp fill then makes the immediate striking of a new arc difficult. One then has to wait for the lamp to cool, or use a sufficiently high voltage to overcome the temporary high resistance. This is the hot restrike problem. Hot restrike may be overcome in several ways, but usually by the application of a high electric field between the main electrodes, for example, by using 26 kilovolts or more across the 4 millimeter arc gap in an automotive HID lamp. This brute force approach is used successfully in automotive HID lamps, where the need to relight the HID headlamps quickly is critical to safe nighttime driving. However, the high voltage source is expensive, and the high voltage, if not safely contained, may be dangerous. For HID lamps to be competitive in consumer markets, it is essential that the ignition voltage and especially the re-ignition voltage of an HID lamp be low. Consumer safety is of paramount importance, and, from a practical standpoint, many existing lamp fixtures are not safety rated for operation above 5 kilovolts. There is then a need to provide an HID lamp with rapid restrike ability without the use of extra high voltage.

DISCLOSURE OF THE INVENTION

A high intensity discharge lamp is constructed with an envelope having a wall defining an enclosed volume, a fill chemistry and a fill gas positioned in the enclosed volume. A first main electrode having an exterior end and an interior end is extended through the wall in a sealed fashion with the interior end positioned in the enclosed volume. A second main electrode having an exterior end and an interior end, the second main electrode is also extended through the wall in a sealed fashion with the interior end positioned in the enclosed volume. The interior end of the first main electrode is offset from the interior end of the second main electrode. The first main electrode and the second main electrode define between them in normal lamp operation a region of plasma discharge. At least a first starting electrode having an exterior end and an interior end is extended through the wall in a sealed fashion with the interior end positioned in the enclosed volume. The first main electrode may be electrically coupled to the first starting electrode by an impedance element. A second starting electrode having an exterior end and an interior end is also extended through the wall in a sealed fashion with the interior end positioned in the enclosed volume. The interior end of the first starting electrode is offset from the interior end of a second starting electrode; and aligned such that a line from the interior end of the first starting electrode to the interior end of the second starting electrode crosses through or adjacent to the region of plasma discharge formed between the interior end of the first main electrode and the interior end of the second main electrode during lamp operation. The first starting electrode includes a thermo-mechanical element intermediate the wall and the interior end of the first starting electrode such that when the thermo-mechanical element is in a cool state the interior end of the first starting electrode is in a first position, and when the thermo-mechanical element is in a heated state the interior end of the first starting electrode is in a second position. The starting electrode positioning is also such that in a cold state the impedance from the exterior end of the first main electrode through the impedance device, if any, and through the first starting electrode in the first position, to the second starting electrode is less than the impedance from the exterior end of the first main electrode through the interior end of the first main electrode to the second main electrode. The starting electrode positioning is also such that in a hot steady, operating state the impedance from the exterior end of the first main electrode through the impedance device, if any, and through the first starting electrode in the second position, to the second starting electrode is greater than the impedance from the exterior end of the first main electrode through the interior end of first main electrode to the second main electrode.

BEST MODE FOR CARRYING OUT THE INVENTION

Figure 1:
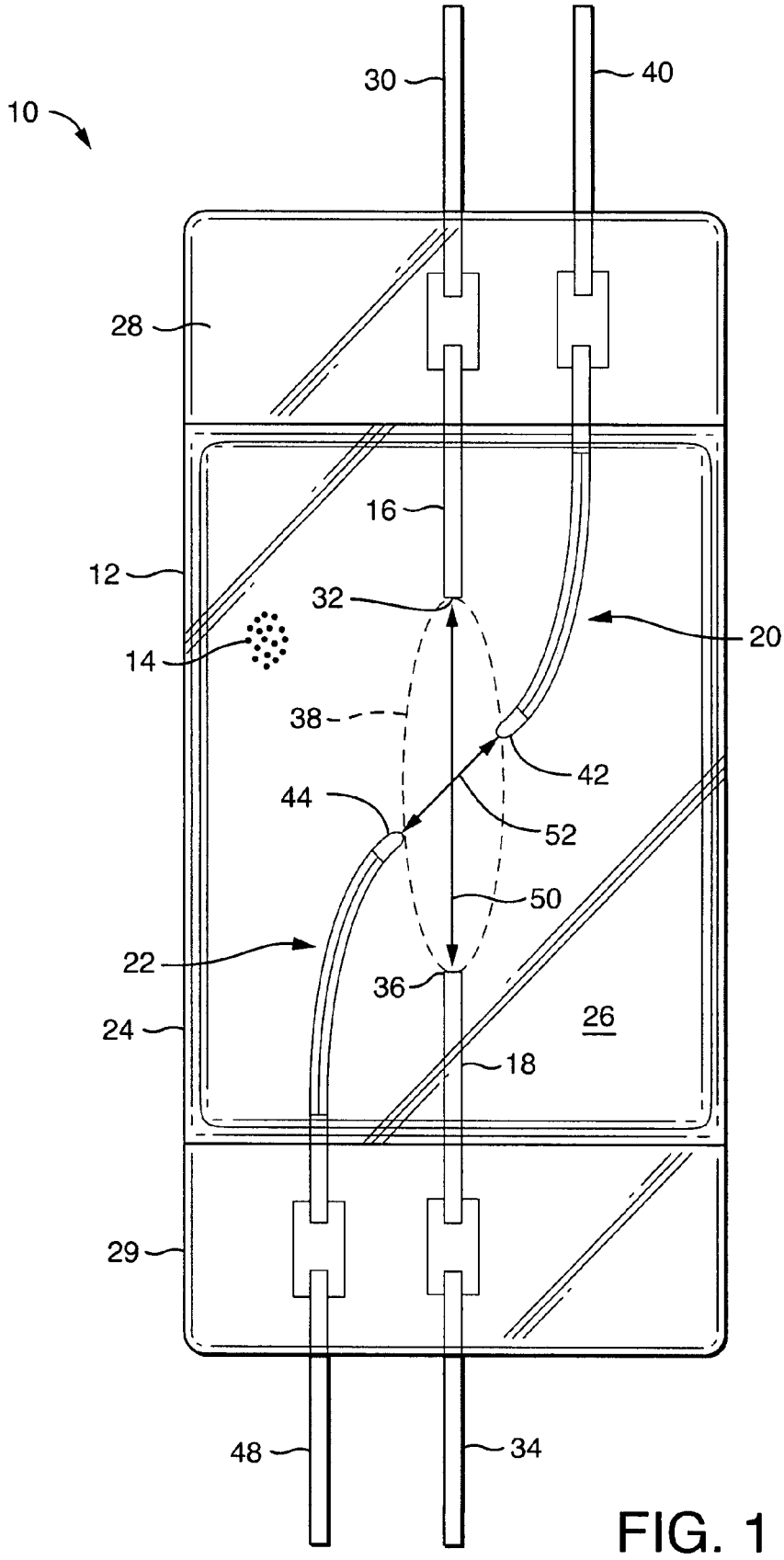
FIG. 1 shows a schematic cross sectional view of a high intensity discharge lamp in a room temperature state.
Figure 2:
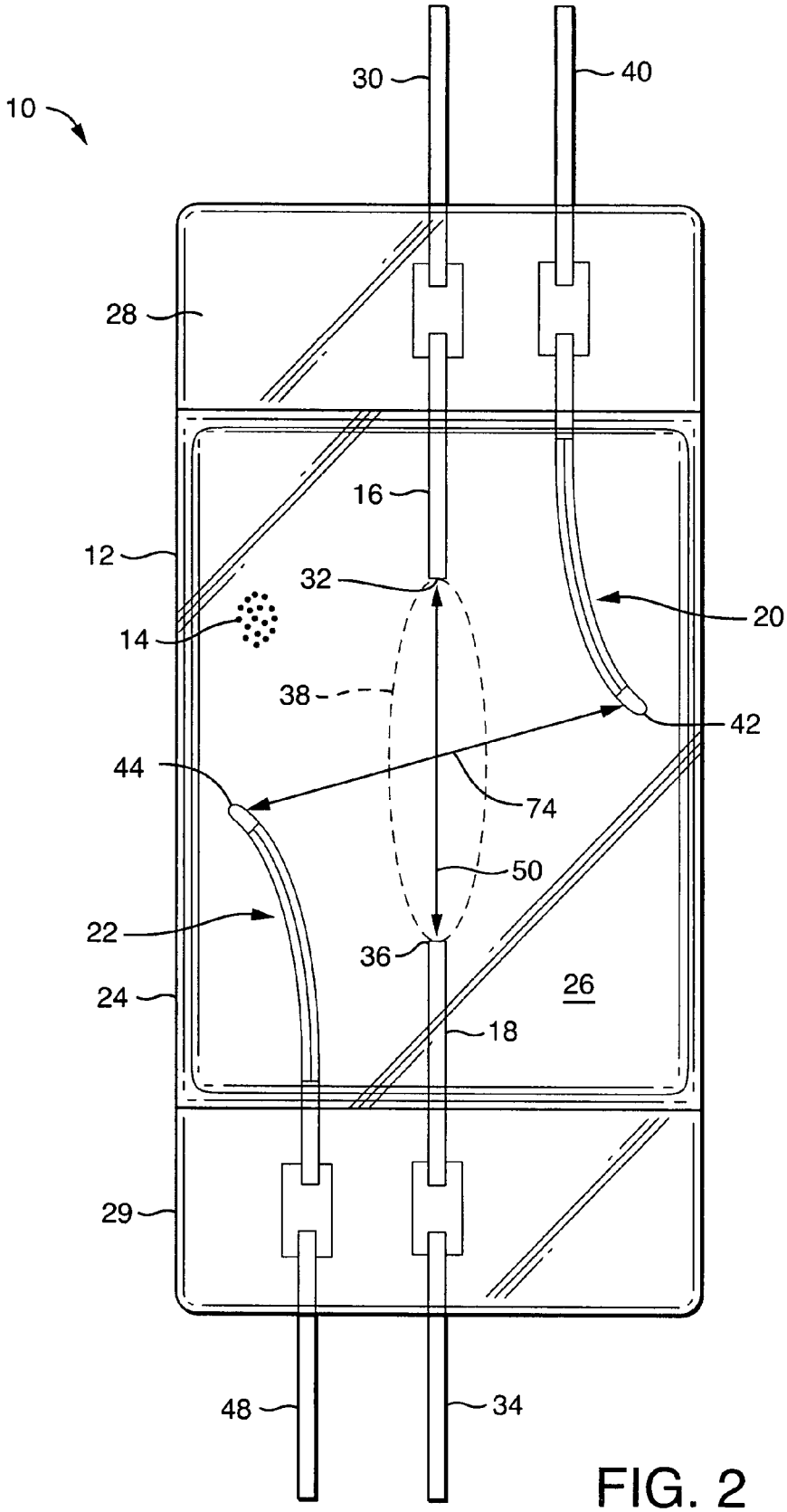
FIG. 2 shows a schematic cross sectional view of the high intensity discharge lamp of FIG. 1 in an operating temperature state.

FIG. 1 shows a schematic cross sectional view of a high intensity discharge lamp 10 in a room temperature state. FIG. 2 shows a schematic cross sectional view of the high intensity discharge lamp of FIG. 1 in an operating temperature state. A high intensity discharge lamp 10 may be formed with an envelope 12, a fill 14 chemistry, a first main electrode 16, a second main electrode 18, a first starting electrode assembly 20 and a second starting electrode assembly 22.

The envelope 12 may be made from any of numerous light transmissive ceramics as known in the art, including such materials as vitreous silica, also known as quartz, polycrystalline alumina (PCA) and others. The envelope 12 includes a wall 24 defining an enclosed volume 26, and one or more seal regions 28, 29.

Contained in the enclosed volume 26 is an appropriate chemical fill 14 that is non-reactive with respect to the two (or more) enclosed elements comprising the bimetallic starting electrode element assembly. Such fill 14 chemistries may include the metal halide fills (salts) well known in the art of lamp making. A preferred chemistry is a mixture of iodide salts of such metals as Thallium, Dysprosium, Holmium, Sodium, and Thulium along with metallic mercury. A neutral fill gas is included in the fill 14, such as a noble gas. The preferred fill gas is argon with a cold pressure of 20,000 Pascals (about 150 torr). Other fill 14 chemistries and gases are known and may be used, provided the components are not reactive with the bimetallic starting electrode assembly elements.

The first main electrode 16 has an exterior end 30 and an interior end 32. The first main electrode 16 is extended through the seal region 28 of the envelope 12 wall 24 in a sealed fashion with the interior end 32 positioned in the enclosed volume 26. The first main electrode 16 may have any of the numerous material and structural configurations of HID lamp electrodes. The preferred electrode has a tungsten inner shaft end.

The second main electrode 18 also has an exterior end 34 and an interior end 36, and is extended through the seal region 29 of the envelope wall 24 in a sealed fashion with the interior end 36 positioned in the enclosed volume 26. The interior end 32 of the first main electrode 16 is axially offset from the interior end 36 of the second main electrode 18. The first main electrode 16 and the second main electrode 18 define between them in normal lamp operation an arc region 38, generally surrounding the least straight line between interior ends 32, 36 of the two main electrodes, between which a plasma discharge forms.

The first starting electrode assembly 20 has an exterior end 40 and an interior end 42, and is extended through the wall 24 in a sealed fashion with the interior end 42 positioned in the enclosed volume 26.

The second starting electrode assembly 22 also has an interior end 44 and an exterior end 48, and is extended through the seal region 29 of envelope wall 24 in a sealed fashion with the interior end 44 positioned in the enclosed volume 26. The interior end 42 of the first starting electrode assembly 20 is laterally offset from the interior end 44 of the second starting electrode assembly 22. The interior end 42 of the first starting electrode assembly 20 and the interior end 44 of the second starting electrode assembly 22 are aligned in a cold state such that the distance 52 from the interior end 42 of the first starting electrode assembly 20 to the interior end 44 of the second starting electrode assembly 22 is less than the distance 50 from the interior end 32 of the first main electrode 16 to the interior end 36 of the second main electrode 18. Further, a least line 52 from the interior end 42 of the first starting electrode assembly 20 to the interior end 44 of the second starting electrode assembly 22 crosses through or near the defined arc region 38 formed between the interior end 32 of the first main electrode 16 and the interior end 36 of the second main electrode 18 during normal lamp operation.

Figure 3:
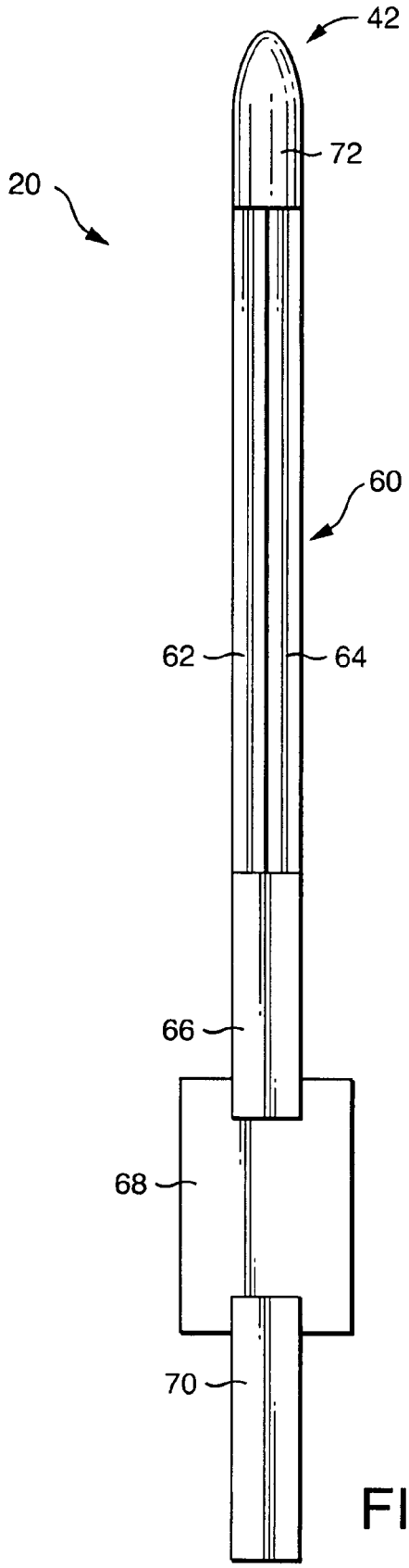
FIG. 3 shows a schematic perspective view of a bimetallic starting electrode.

FIG. 3 shows a schematic view of a bi-metallic starting electrode assembly 20. The first starting electrode assembly 20 includes a thermo-mechanical element 60 intermediate the wall 24 and the interior end 42 of the first starting electrode assembly 20 such that when the thermo-mechanical element 60 is in a cool state, the interior end 42 is in a first position, and when the thermo-mechanical element 60 is in a heated state typical of the normal lamp operating temperature, the interior end 42 is in a second position. The thermo-mechanical element 60 may be a bimetallic piece formed from a first metal 62 and a second metal 64. The first metal 62 and the second metal 64 each have a melting temperature greater than the normal internal operating temperature of the lamp 10, where the bimetal is located in its heated and deflected position. It is the local temperature adjacent the bimetal in the heated and deflected position that is of concern. The melting temperatures of the preferred first metal 62 and the preferred second metal 64 do not need to exceed the hottest, core temperature of the discharge plasma. The first metal 62 and the second metal 64 also have thermal coefficients of expansion each different from the other. Suggested bi-metallic elements may include combinations of a first metal or substantial alloy thereof, and a second metal or substantial alloy thereof each selected metal from the group comprising: tungsten, molybdenum, rhenium, osmium, tantalum, niobium, iridium and ruthenium. The two metals 62, 64 are formed as thin sheets and then bonded together as a single extended shaft or strip, for example by laser welding, e-beam welding, ultrasonic welding or similarly fusing the side edges or adjacent faces of the sheets to form a solidly bonded single elongated shaft like piece. The bimetallic element 60 may then be mechanically and electrically joined to an electrically conductive exterior end or seal portion 66, for example a portion similar to the main electrode portion passing through the seal region 28. The starting electrode assembly 20 may include a seal foil 68 and an outer contact lead 70. The exterior end or seal portion 66 of the first starting electrode assembly 20 may then be sealed through the seal region 28. The inner end of the bimetallic element 60 may be mechanically and electrically joined to an electrically conductive inner end 72, such as a tungsten tip. In the preferred embodiment, the second starting electrode assembly 22 is similarly formed. The first starting electrode assembly 20 and the second starting electrode assembly 22 are positioned so that their respective interior ends 42, 44 in a cold (room temperature) condition have a shorter separation distance 52 than the separation distance 50 between the interior end of the first main electrode 16 and the interior end of the second main electrode 18, and the shortest line of separation 52 passes near or traverses the arc envelope 38 region. The first starting electrode assembly 20 and the second starting electrode assembly 22 are further positioned so that the corresponding interior ends 42, 44 have a separation distance 74 in the heated position that is greater than the separation distance 50 between the first main electrode 16 and the second main electrode 18, so that a discharge path between the main electrodes 16, 18 is favored. The interior ends 42, 44 of the first starting electrode 20 and the second starting electrode 22 in the heated (deflected) condition are also offset sufficiently from the respective opposite main electrode 16, 18 so as not to act as an alternative discharge path during the heated condition typical of normal lamp operation.

Figure 4:
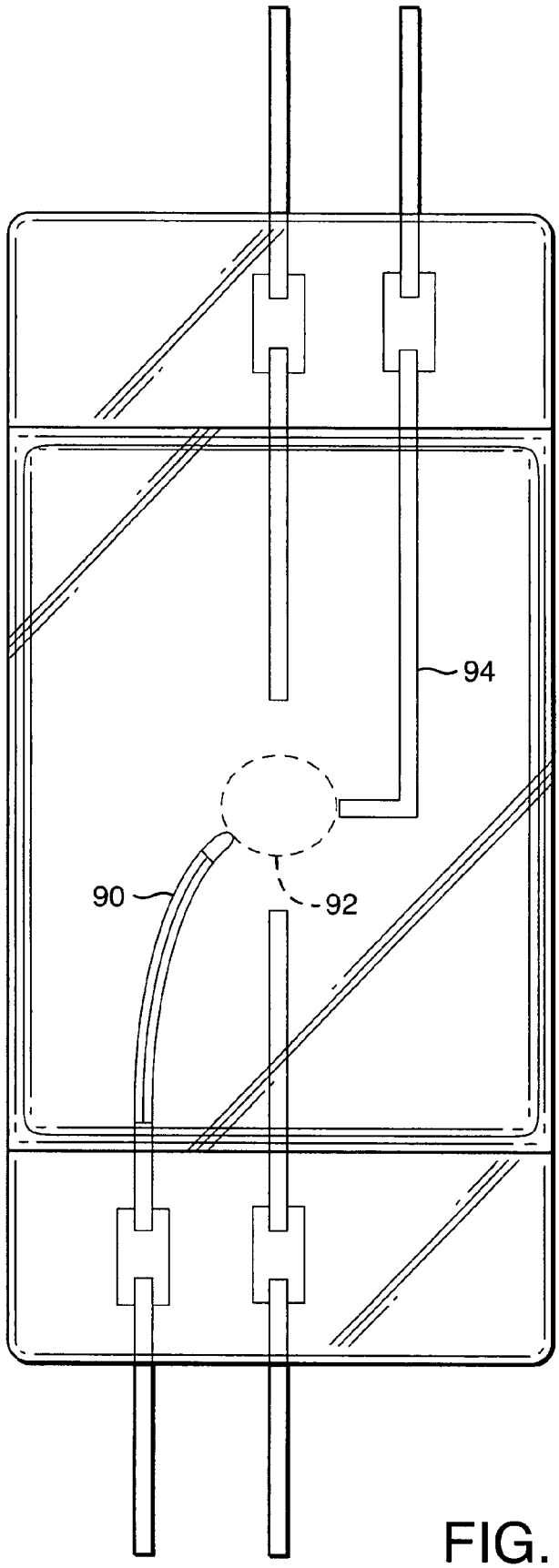
FIG. 4 shows a schematic cross sectional view of an alternative embodiment of a lamp with a thermo-mechanical starting electrode.

FIG. 4 shows a schematic cross sectional view of an alternative embodiment of a lamp with a thermo-mechanical starting electrode. The first starting electrode 90 can be positioned to strike a starting arc 92 with a second starting electrode 94 that does not include a bimetallic section. The second starting electrode 94 is then mechanically fixed. This may be less expensive to manufacture, as the second starting electrode 94 would have fewer components. On the other hand, there is simplicity in forming a symmetric lamp, and having both starting electrodes withdraw from the main arc region may allow each starting electrode to be designed to have a smaller deflection requirement.

Figure 5:
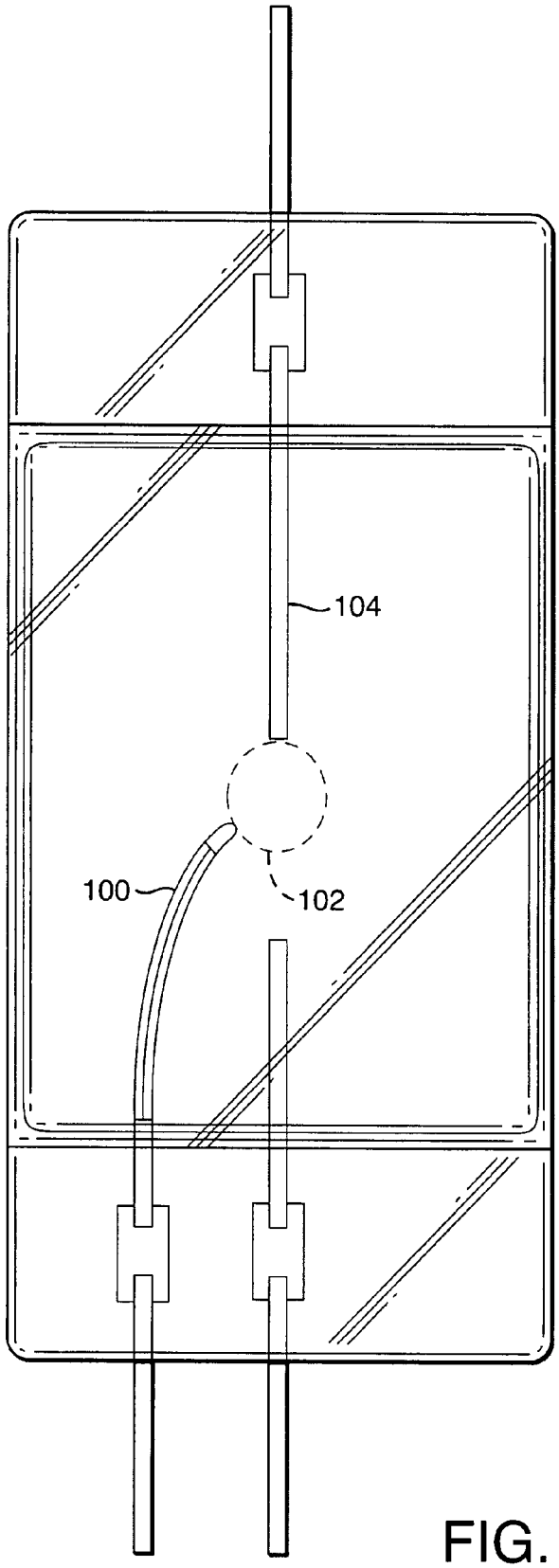
FIG. 5 shows a schematic cross sectional view of an alternative embodiment of a lamp with a thermo-mechanical starting electrode.

FIG. 5 shows a schematic cross sectional view of an alternative embodiment of a lamp with a thermo-mechanical starting electrode. The first starting electrode 100 can be positioned to strike a starting arc 102 with the second main electrode 104. The second main electrode is effectively the same as the second starting electrode. This is a less preferred alternative as the full power of the main electrode 104 could overwhelm the bimetallic starting electrode. The use of a current limiting resistor or other electronics may be additionally used to protect the bimetallic starting electrode. Overpowering may be accommodated with a ballast providing for the initial starting arc through the bimetallic starting electrode, while sensing the transition to the main arc through the main electrode. Once the main arc is started, the power may be increased, as the bimetallic starting electrode 100 quickly heats, deflects away and separates from the main arc circuit.

Figure 6:
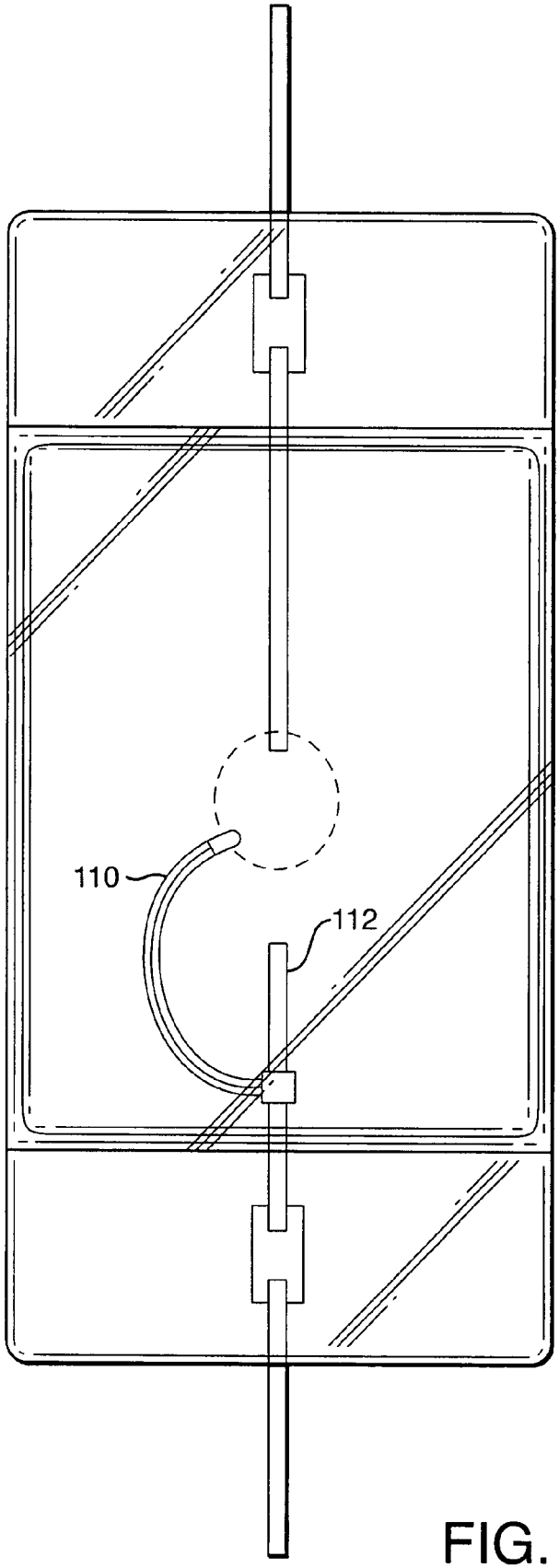
FIG. 6 shows a schematic view of an alternative embodiment of a lamp with a thermo-mechanical starting electrode.

FIG. 6 shows a schematic view of an alternative embodiment of a lamp with a thermo-mechanical starting electrode 110. The first starting electrode 110 can be mechanically and electrically supported from the root of the first main electrode 112. The electric power for the starting electrode 110 then comes through the first main electrode 112. This is a less preferred alternative as the full power of the main electrode 112 could overwhelm the bimetallic starting electrode 110. Overpowering may again be accommodated by a ballast providing for the initial starting arc through the bimetallic starting electrode 110, while sensing the transition to the main arc through the main electrode 112. Once the main arc is started, the power may be increased, as the bimetallic starting electrode 110 quickly heats, deflects away from the main plasma arc and separates from the circuit. It should be clear that the starting arc may be struck between a bimetallic starting electrode and the second main electrode. The second main electrode then effectively serves as both the second starting electrode and the second main electrode.

Figure 7:
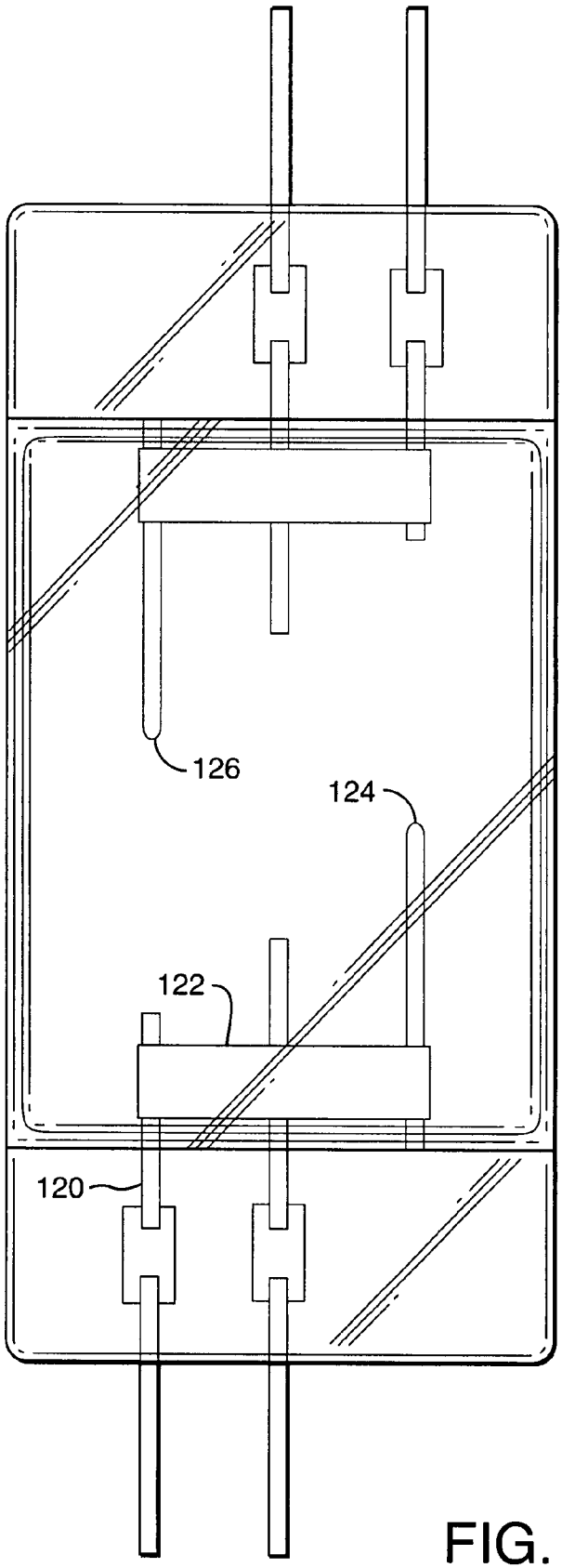
FIG. 7 shows a schematic view of an alternative embodiment of a lamp with a thermo-mechanical starting electrode.

FIG. 7 shows a schematic view of an alternative embodiment of a lamp with a thermo-mechanical starting electrode. An in-lead 120 is attached to a first end of bimetallic spiral strip 122. A second end of the bimetallic spiral strip 122 is formed as, or is attached to, an axially projecting starting electrode tip 124. A similarly formed structure may be placed at the opposite end of the lamp interior. In the cool state the bimetallic spiral strip 122 is contracted, moving the first starting electrode tip 124 radially inwards toward the central lamp axis, thereby shortening the distance from the first starting electrode tip 124 to the second starting electrode tip 126. The second starting electrode tip 126 may be similarly mounted on a similarly formed second spiral bi-metallic structure, or may be mounted on one of the previously described laterally deflecting structures, or a fixed second starting electrode or the second main electrode tip. In the heated state, the spiral bimetallic strip 122 radially extends or its corresponding starting electrode tip rotationally turns or both to move the first starting electrode tip 124 farther away from the corresponding second starting electrode tip 126. Again the shorter distance between the starting electrode tips 124, 126 in the cooler state is easier to ignite an arc across than between the fixed ends of the first main electrode and the second main electrode. The starting arc then supplies plasma charges that enable the rapid initiation of an arc between the first main electrode and the second main electrode.

Figure 8:
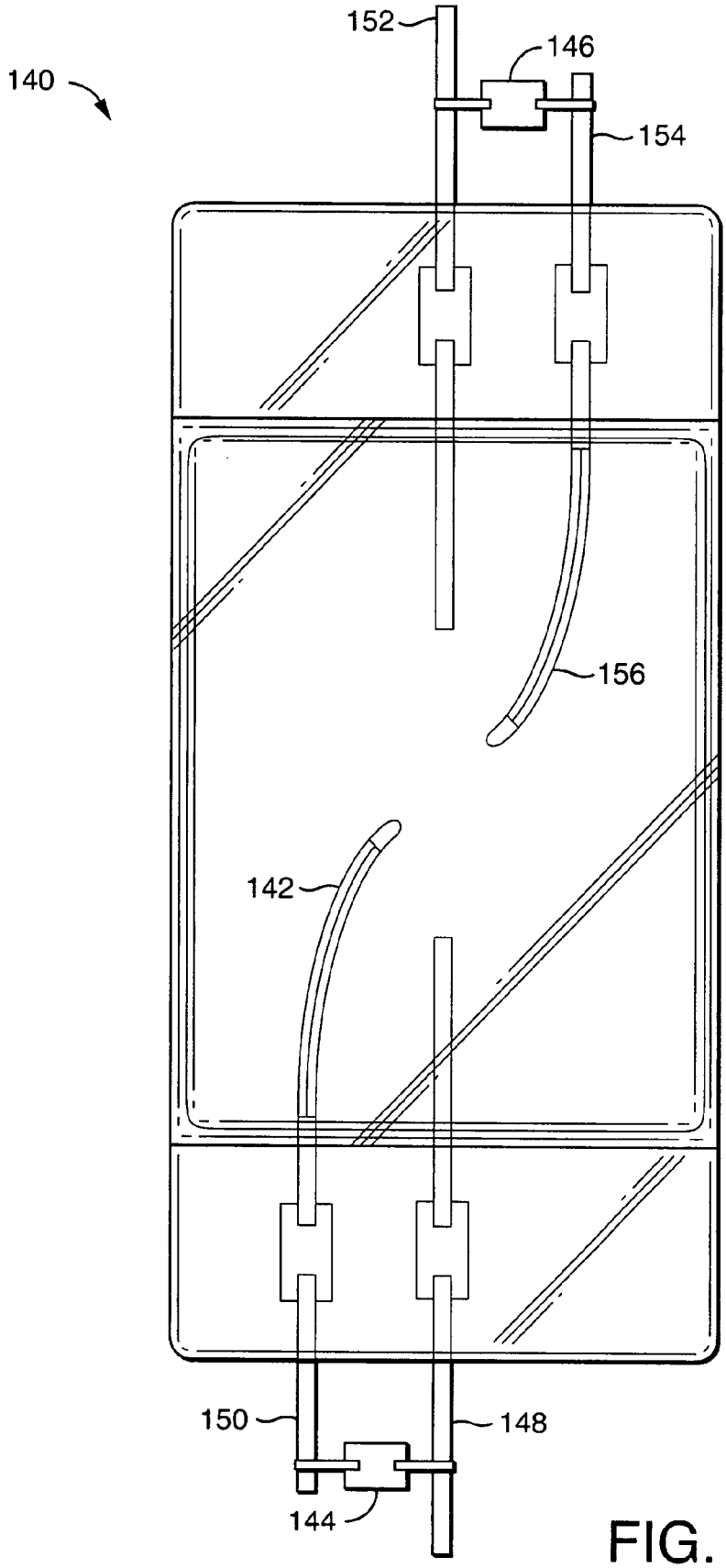
FIG. 8 shows a schematic view of lamp with a thermo-mechanical starting aid and an impedance element.

FIG. 8 shows a schematic view of lamp 140 with a thermo-mechanical starting aid 142 and generic impedance elements 144, 146 coupled respectively between the first main electrode 148 and the first starting electrode 150, and the second main electrode 152 and the second starting electrode 154. The lamp 140 is constructed so the circuit through the bimetallic electrodes 142, 156, in the cold state, has an impedance, including the impedance of the impedance elements 144, 146 that is less than the impedance of the circuit through the main electrodes 148 and 152, in the cold state; and the circuit through the bi-metallic electrodes 142, 156 including the impedance elements 144, 146 in the hot state has an impedance that is greater than the impedance of the circuit through the main electrodes 148, 152 in the hot state. Heating increases the distance between the bimetallic electrodes 142, 156 and therefore the bi-metallic starting electrode path impedance, which then supplements the impedance provided by the impedance elements 144, 146, sufficiently to make the impedance through the bimetallic starting electrodes 142, 156 greater than the impedance through the main electrodes 148, 152. As the relative impedance of the bimetallic starting electrode path increases over the impedance of the main electrode path, conduction switches from between the bimetallic starting electrodes 142, 156, to between the main electrodes 148, 152. The impedance element 144 may be a simple resistor, or may be a more complex circuit with timing, controlling or other functions. It is understood that one or both of the impedance elements can be used or eliminated depending on the remaining impedances of the respective paths in the cold and hot states.

In one embodiment, the thermo-mechanical element 60 was formed from a 0.228 (0.009 inch) thick molybdenum substrate joined to a corresponding 0.033 millimeter (0.0013 inch) thick tungsten ribbon to form a 25 millimeter long by 4 millimeter wide structurally sound tungsten-molybdenum bimetallic shaft like structure. The bimetallic structure was fabricated by laser welding a continuous seam around the rectangular perimeter of the composite strip. The welding was done while flowing an argon atmosphere around the weld region to preclude oxidation of the molybdenum and tungsten components. The molybdenum and tungsten strips could have been welded together by ultrasonic means or by hot roll bonding.

To facilitate deflection testing of the bimetallic strip by external radiative heating from a torch flame, without the risk of oxidation damage, the bimetallic strip was mounted cantilever style inside an evacuated and sealed cylindrical quartz capsule (15 millimeter outside diameter by 13 millimeter inside diameter by 64 millimeter long). Heating the capsule to about 900 degrees Celsius produced about a 2.5 millimeter lateral deflection of the free end of the tungsten-molybdenum bimetallic strip, bending away from the molybdenum side. The bi-metallic bending demonstrated that significant lateral deflection of the free end of the tungsten-molybdenum bimetallic strip could be implemented as an auxiliary variable length arc gap in an HID arc tube. The difference between the thermal expansion coefficients of molybdenum and tungsten is quite small, on the order of 1.5 ppm/C, over the temperature range of interest (room temperature to about 1000 degrees Celsius).

The thermally induced deflection of the free end of the bimetallic strip, the other end being clamped, is nominally proportional to the product of the difference in thermal expansion coefficients of the two metals and the change in temperature to which the bimetallic strip is exposed. In many other lower temperature applications using other metals, the difference between the thermal expansion coefficients is greater, for example, by about 20 ppm/C, but the operational temperature range is smaller.

Theory predicted that the thermally induced deflection could be substantially enhanced by reducing the overall thickness of the strip or by lengthening the strip. For validation purposes, a second tungsten-molybdenum bi-metallic element, 50.8 millimeter long, 3.2 millimeter wide, and 0.066 millimeters (0.0026 inch) thick, was fabricated using the same laser welding process. The bi-metallic strip was then sealed in a larger cylindrical quartz capsule (50 millimeter outside diameter by 47 millimeter inside diameter by 80 millimeter long). Subjected to heating conditions similar to the first case (900 degrees Celsius in 100 torr of nitrogen), the tip of the single bi-metallic strip deflected laterally about 20 millimeters, more than enough for use in a 400 watt metal halide HID arc tube (about 18 millimeters inside diameter).

External current limiting resistors may be used in series with the auxiliary bi-metallic starting electrodes. Because the free ends of the bimetallic strips are closer to each other than are the tips of the corresponding main electrodes, a small startup arc forms between the free ends of the bimetallic strips when an appropriate ignition pulse is applied to the arc tube. An extra tungsten tip is preferably welded to the free end of each bimetallic strip to withstand the elevated arc temperatures when the starting arc is initiated.

The startup arc heats the bimetallic assemblies, causing the respective free ends to deflect away from the mid line of the arc tube and toward the side wall of the cylindrical capsule. At some point as the bimetallic starting electrodes laterally deflect and the tip to tip distance increases, and the startup arc extinguishes. This occurs because the effective resistance of the arc gap increases with increasing arc gap length. As a result, the voltage (or power) across the starting electrode gap increases, until the needed voltage (or power) exceeds the output capability of the ballast power supply, thereby extinguishing the startup arc.

The residual ionization produced from the startup arc of the surrounding gas between the main electrodes 16, 18 reduces the impedance between the main electrodes 16, 18 (maintained at full open circuit potential), allowing the main arc between the main electrodes 16, 18 to ignite. Once ignited the main arc heats the lamp, including the starting electrodes 20, 22. The sustaining heat generated by the main arc causes the bi-metallic elements of the starting electrodes 20, 22 to remain deflected or to splay farther apart, causing the starting electrode tips 42, 44 to reside near or at the side wall of the arc tube during steady state operation. The main arc may ignite before the startup arc extinguishes. If that happens, the voltage across the main arc decreases from open circuit ignition values to much lower steady state running values, effectively shutting off the startup arc. The net result is the same as if the startup arc had extinguished by sufficient lateral deflection of the starting electrodes.

When power to the arc tube is shut off, the free ends of the fully-splayed bimetallic elements 60 cool. The interior ends 42, 44 of the starting electrodes 20, 22 begin to re-approach each other because heat is drawn from the bimetallic elements 60, primarily by thermal conduction through the corresponding starting electrode components to the exterior of the arc tube, and also to a lesser extent by radiation and convection. The conduction heat transfer process is more rapid (estimated to be at least 10 or more times faster) than the heat transfer from the entire arc tube (primarily by radiation) to the external environment. As the effective gap between the bimetallic tungsten tips decreases toward the original room temperature midline condition, re-ignition of the startup arc is possible, repeating the cycle described above.

The cool down of the bimetallic elements 60 (and the consequent reduction in their effective arc gap length) is faster than the overall cool down of the arc tube enclosure and the enclosed gas fill. The ability to relight (re-ignite) the main arc after the main arc is extinguished is then substantially improved. In heating up experiments with the 50.8 millimeter long tungsten molybdenum bi-metallic strip in a quartz test vessel, the free end of the starting electrode returned about 20 millimeters in about 25 seconds. This return deflection time delay is significantly shorter than the typical 10-minute re-ignition time required for a 400-watt HID quartz lamp of conventional construction (without the bimetallic starting electrodes). It is anticipated that the return deflection time of the bi-metallic starting electrodes in an arc tube as described herein will diminish because heat transfer from the extinguished main arc to and through the bi-metallic starting electrode will be dominated by thermal conduction rather than by radiation.

A ceramic arc tube using the same principles can be made using two single-ended arc tubes. Two modest disadvantages are the additional cost of the bimetallic strips, and the slight shading (light obscuration) caused by the bi-metallic strips. It is believed that the slight lumen loss is a small price to pay for rapid restrike ability. It should be understood that While there have been shown and described what are at present considered to be the preferred embodiments of the invention, it will be apparent to those skilled in the art that various changes and modifications can be made herein without departing from the scope of the invention defined by the appended claims.

What is claimed is:

1. A high intensity discharge lamp, comprising:

an envelope having a wall defining an enclosed volume;

a fill chemistry and a fill gas positioned in the enclosed volume;

a first main electrode having an exterior end and an interior end, the first main electrode extended through the wall in a sealed fashion with the interior end positioned in the enclosed volume;

a second main electrode having an exterior end and an interior end, the second main electrode extended through the wall in a sealed fashion with the interior end positioned in the enclosed volume; the interior end of the first main electrode being offset from the interior end of the second main electrode; the first main electrode and the second main electrode defining between them in normal lamp operation a region of plasma discharge;

at least a first starting electrode having an exterior end and an interior end, the first starting electrode extended through the wall in a sealed fashion with the interior end positioned in the enclosed volume;

a second starting electrode having an exterior end and an interior end, and extended through the wall in a sealed fashion with the interior end positioned in the enclosed volume;

the interior end of the first starting electrode being offset from the interior end of a second starting electrode; and aligned such that a line from the interior end of the first starting electrode to the interior end of the second starting electrode crosses through or adjacent to the region of plasma discharge formed between the interior end of the first main electrode and the interior end of the second main electrode during normal lamp operation;

the first starting electrode including a thermo-mechanical element intermediate the wall and the interior end of the first starting electrode such that when the thermo-mechanical element is in a cool state the interior end of the first starting electrode is in a first position, and when the thermo-mechanical element is in a heated state the interior end of the first starting electrode is in a second position; such that in a cold state the impedance from the exterior end of the first starting electrode in the first position through the interior end of first starting electrode, to the interior end of the second starting electrode is less than the impedance from the exterior end of the first main electrode through the interior end of first main electrode to the interior end of the second main electrode, and such that in a hot state the impedance from the exterior end of the first starting electrode in the second position, through the interior end of first starting electrode to the interior end of the second starting electrode is greater than the impedance from the exterior end of the first main electrode through the interior end of first main electrode to the interior end of the second main electrode.

2. The lamp in claim 1, wherein the second starting electrode is different from the second main electrode.

3. The lamp in claim 1, wherein the second starting electrode is the second main electrode.

4. The lamp in claim 1, wherein the first main electrode is electrically coupled to the first starting electrode by an impedance element.

5. The lamp in claim 2, wherein the second main electrode is electrically coupled to the second starting electrode by an impedance element.

6. The lamp in claim 2, wherein the second starting electrode includes a bi-metallic element forming at least a portion of the second starting electrode intermediate the wall and the interior end.

7. The lamp in claim 2, wherein the second starting electrode does not include a bimetallic element forming at least a portion of the starting electrode intermediate the wall and the interior end.

8. The lamp in claim 1, wherein the first starting electrode is mechanically and electrically coupled in the enclosed volume to a root portion of the first main electrode.

9. The lamp in claim 1, wherein the bimetallic element includes a first metal or substantial alloy thereof selected from the group comprising: tungsten, molybdenum, rhenium, osmium, tantalum, niobium, iridium and ruthenium.

10. The lamp in claim 1, wherein the first starting electrode is positioned in a cold state to form a starting arc with the second main electrode.

11. The lamp in claim 1, wherein the first starting electrode is positioned in a cold state to form a starting arc with the second starting electrode being different from the second main electrode.

12. The lamp in claim 2, wherein the second starting electrode includes a bi-metallic element forming at least a portion of the starting electrode intermediate the wall and the interior end.

13. The lamp in claim 2, wherein the second starting electrode does not include a bi-metallic element forming at least a portion of the starting electrode intermediate the wall and the interior end.

14. The lamp in claim 1, wherein the first starting electrode includes a thermo-mechanical element intermediate the wall and the interior end such that when the thermo-mechanical element is in a heated state, the interior end of the first starting electrode is positioned at a greater distance from a line extending between the interior end of the first main electrode and the interior end of the second main electrode.

15. The lamp in claim 1, having an impedance element electrically coupled between the first starting electrode and the first main electrode.

16. The lamp in claim 15, wherein the impedance element is a resistor.

17. The lamp in claim 15, having an impedance element electrically coupled between the second starting electrode and the second main electrode.

18. The lamp in claim 17, wherein the impedance element coupled between the second starting electrode and the second main electrode is a resistor.

19. A high intensity discharge lamp, comprising:

an envelope having a wall defining an enclosed volume;

a fill chemistry and a fill gas positioned in the enclosed volume;

a first main electrode having an exterior end and an interior end, the first main electrode extended through the wall in a sealed fashion with the interior end positioned in the enclosed volume;

a second main electrode having an exterior end and an interior end, the second main electrode extended through the wall in a sealed fashion with the interior end positioned in the enclosed volume; the interior end of the first main electrode being offset from the interior end of the second main electrode; the first main electrode and the second main electrode defining between them in normal lamp operation a region of plasma discharge;

at least a first starting electrode having an exterior end and an interior end, and extended through the wall in a sealed fashion with the interior end positioned in the enclosed volume;

a second starting electrode having an exterior end and an interior end, and extended through the wall in a sealed fashion with the interior end positioned in the enclosed volume;

the interior end of the first starting electrode being offset from the interior end of a second starting electrode; and aligned in a cold state such that the distance from the interior end of the first starting electrode to the interior end of the second starting electrode is less than a least distance from the interior end of the first main electrode to the interior end of the second main electrode, and a line from the interior end of the first starting electrode to the interior end of the second starting electrode crosses through or close to the region of plasma discharge formed between the interior end of the first main electrode and the interior end of the second main electrode during lamp operation;

the first starting electrode including a thermo-mechanical element intermediate the wall and the interior end such that when the thermo-mechanical element is in a cool state the interior end of the first starting electrode is in a first position, and when the thermo-mechanical element is in a heated state the interior end of the first starting electrode is in a second position; and the least distance from the first starting electrode to the second starting electrode in the cool state is less than the least distance from the first main electrode to the second main electrode, and the least distance from the first starting electrode to the second starting electrode in the heated state is greater than the least distance from the first main electrode to the second main electrode.

20. A high intensity discharge lamp, comprising:

an envelope having a wall defining an enclosed volume; a fill chemistry and a fill gas positioned in the enclosed volume; a first main electrode having an exterior end and an interior end, the first main electrode extended through the wall in a sealed fashion with the interior end positioned in the enclosed volume;

a second main electrode having an exterior end and an interior end, the second main electrode extended through the wall in a sealed fashion with the interior end positioned in the enclosed volume; the interior end of the first main electrode being offset from the interior end of the second main electrode; the first main electrode and the second main electrode defining between them in normal lamp operation a region of plasma discharge;

a first starting electrode having an exterior end and an interior end, and extended through the wall in a sealed fashion with the interior end positioned in the enclosed volume;

a second starting electrode having an exterior end and an interior end, and extended through the wall in a sealed fashion with the interior end positioned in the enclosed volume; the interior end of the first starting electrode being offset from the interior end of the second starting electrode; and aligned in a cold state such that the distance from the interior end of the first starting electrode to the interior end of the second starting electrode is less than a least distance from the interior end of the first main electrode to the interior end of the second main electrode, and a line from the interior end of the first starting electrode to the interior end of the second starting electrode crosses through the region of plasma discharge formed between the interior end of the first main electrode and the interior end of the second main electrode during lamp operation;

the first starting electrode including a thermo-mechanical element intermediate the wall and the interior end such that when the thermo-mechanical element is in a cool state the interior end of the first starting electrode is in a first position, and when the thermo-mechanical element is in a heated state the interior end of the first starting electrode is in a second position, and the interior end of the first starting electrode in the second position is positioned at a greater distance from a line extending between the interior end of the first main electrode and the interior end of the second main electrode than the interior end of the first starting electrode in the first position.

21. A method of operating an arc discharge lamp comprising the steps of:

providing an arc discharge lamp with a first main electrode and a second main electrode defining there between a region of arc discharge during normal lamp operation, and at least one starting electrode having a portion formed from a thermo-mechanical element;

initiating a starting arc between an interior end of the starting electrode and a second electrode, the starting arc extending in the defined region of normal operating arc discharge;

initiating a voltage difference between the interior end of the first main electrode and the interior end of the second main electrode;

initiating a main arc between the first main electrode and the second main electrode; and heating the thermo-mechanical portion of the starting electrode causing mechanical deflection of the interior end of the starting electrode away from the region of arc discharge during normal lamp operation.

22. A high intensity discharge lamp, comprising:

an envelope having a wall defining an enclosed volume;

a fill chemistry and a fill gas positioned in the enclosed volume;

a first main electrode having an exterior end and an interior end, the first main electrode extending through the wall in a sealed fashion with the interior end positioned in the enclosed volume;

a second main electrode having an exterior end and an interior end, the second main electrode extending through the wall in a sealed fashion with the interior end positioned in the enclosed volume; the interior end of the first main electrode being offset from the interior end of the second main electrode; the first main electrode and the second main electrode defining between them a region of plasma discharge during normal lamp operation;

at least a first starting electrode having an exterior end and an interior end, the first starting electrode extending through the wall in a sealed fashion with the interior end positioned in the enclosed volume;

a second starting electrode having an exterior end and an interior end, and extended through the wall in a sealed fashion with the interior end positioned in the enclosed volume; the second main electrode being electrically coupled to the second starting electrode by an impedance element;

a first impedance element electrically coupled between the first starting electrode and the first main electrode;

a second impedance element electrically coupled between the second starting electrode and second main electrode;

the interior end of the first starting electrode being offset from the interior end of a second starting electrode; and aligned such that a line from the interior end of the first starting electrode to the interior end of the second starting electrode crosses through or adjacent to the region of plasma discharge formed between the interior end of the first main electrode and the interior end of the second main electrode during normal lamp operation;

the first starting electrode including a thermo-mechanical element intermediate the wall and the interior end of the first starting electrode such that when the thermo-mechanical element is in a cool state the interior end of the first starting electrode is in a first position, and when the thermo-mechanical element is in a heated state the interior end of the first starting electrode is in a second position;

the second starting electrode including a thermo-mechanical element intermediate the wall and the interior end of the second starting electrode such that when the thermo-mechanical element is in a cool state the interior end of the second starting electrode is in a first position, and when the thermo-mechanical element is in a heated state the interior end of the second starting electrode is in a second position;

such that in a cold state the impedance from the exterior end of the first main electrode through the first impedance device, and through the first starting electrode in the first position, to the second starting electrode in the first position through the second impedance device to the exterior end of the second main electrode is less than the impedance from the exterior end of the first main electrode through the interior end of the first main electrode to the interior end of the second main electrode to the exterior end of the second main electrode; and such that in a hot state the impedance from the exterior end of the first main electrode through the first impedance device, and through the first starting electrode in the second position, to the second starting electrode in the second position through the second impedance device to the exterior end of the second main electrode is greater than the impedance from the exterior end of the first main electrode through the interior end of the first main electrode to the interior end of the second main electrode to the exterior end of the second main electrode.

* * * * *